United States Patent [19]

Zingler

[11] Patent Number: 4,557,423

[45] Date of Patent: Dec. 10, 1985

[54] COMBINED CLAMPING AND CUTTING SYSTEM FOR MOVING FILAMENT

[75] Inventor: Christian J. Zingler, Succasunna, N.J.

[73] Assignee: Electric Power Research Institute, Inc., Palo Alto, Calif.

[21] Appl. No.: 632,895

[22] Filed: Jul. 20, 1984

[51] Int. Cl.[4] ..... B65H 54/00; B65H 65/00; B65H 75/28

[52] U.S. Cl. ..... 242/25 R; 242/19; 242/25 A; 242/47; 242/48; 242/125.1

[58] Field of Search ..... 242/25 R, 25 A, 18 R, 242/18 A, 18 PW, 19, 47, 48, 74, 74.1, 74.2, 78, 78.1, 78.3, 56 R, 125.1

[56] References Cited

U.S. PATENT DOCUMENTS 4,116,394 9/1978 Smith et al. ..... 242/25 R 4,239,187 12/1980 Boggs et al. ..... 242/25 R

*Primary Examiner*—Stanley N. Gilreath

*Attorney, Agent, or Firm*—King, Liles and Schickli

[57] ABSTRACT

An apparatus and method are provided for winding an advancing filament or the like being fed by a transfer device. The filament is clamped to a rotating winding wheel and the filament leader is cut for disposal. The apparatus includes a combined clamping and cutting element mounted for rotation with the wheel. The element includes a pivotable arm having a free cutting knife facing the direction of filament travel. When actuated, the arm pivots from an open position away from the wheel to a closed position wherein the arm engages the filament and the wheel so as to retain the advancing filament on the wheel. Following clamping engagement the rotating brush rollers pull the filament leader forcing the filament against the cutting edge as the wheel continues to rotate so as to cut the filament leader. The method includes the steps of; tensioning the filament as it is drawn past the wheel; clamping the filament to the wheel; and pulling the filament against the free cutting edge as the wheel rotates following clamping engagement so as to cut the leader for removal.

12 Claims, 8 Drawing Figures

COMBINED CLAMPING AND CUTTING SYSTEM FOR MOVING FILAMENT

TECHNICAL FIELD

The present invention relates generally to the winding of a continuous cast filament, from a continuous forming process, onto a rotating take-up device. More particularly, the present invention provides an apparatus and method for clamping a filament to a rotating winding wheel on the fly, cutting the filament leader and winding the filament on the wheel.

BACKGROUND ART

Glassy or amorphous alloys are of considerable technological interest owing to their unique physical properties as compared to the properties characterizing the polycrystalline forms of such alloys. In particular, cast products having a glassy structure, in the form of a filament or relatively thin elongated ribbon, have proven to be effective for winding into highly efficient cores for electrical transformers or other uses. Some recent developments in the casting of amorphous or glassy metal ribbons are reviewed in U.S. Pat. No. 4,332,848.

As is well known in the art, glassy alloys are rapidly quenched or cooled from a liquid state to a substantially amorphous solid state, typically having less than about 50% crystallinity. The quenching occurs at extreme cooling rates, namely, on the order to $10^6$ °C./sec. The ribbon is typically formed by extruding the molten alloy from a pressurized reservoir through a restricted orifice of a nozzle onto a high speed cooling surface. The cast filaments are necessarily thin, owing to the extreme heat transfer requirement for preventing substantial crystallization.

It is necessary to wind the cast filament onto a storage wheel or reel in line with the casting apparatus for later processing into a transformer core or the like. The initiation of the in line winding process, however, is difficult since the casting speeds are so high, typically on the order of 1000–2000 meters per minute. Thus, the leading portion of the high speed filament must be captured on the fly as it departs the rapidly rotating cooling surface, then transferred and clamped to the take-up wheel and finally wound on the wheel. Exemplary prior arrangements of this type are shown in U.S. Pat. No. 4,116,394 to Smith et al and U.S. Pat. No. 4,239,187 to Boggs et al. As should be appreciated, the clamping must be accomplished quickly and precisely or an entangled mass of filament rapidly accumulates since the casting process is continuing throughout this operation at a rapid pace.

Heretofore, the gripping mechanism for clamping the filament to the storage wheel generally has taken the form of a pivotal filament gripping element mounted for rotation with the storage wheel (see Smith '394 patent). The gripping element includes a movable gripping lever formed with a gripping face and a cutting edge. The movable cutting edge cooperates with a stationary edge on the wheel. When actuated, the lever is designed to pivot and clamp the filament against the wheel. The two cutting edges are designed to cooperate and simultaneously cut the filament with the severed leader end of the filament being cast aside.

Disadvantageously, however, the Smith apparatus often fails to reliably provide the necessary gripping and cutting action to the filament. When the proper cutting action is not provided, the filament leader is pulled back onto the winding wheel to disrupt filament winding. In other instances, the cutting action may occur just prior to rather than simultaneously with, the clamping. When this occurs the filament slips free from between the gripping lever and the wheel, quickly becoming an entangled mass. Either of the above failures results in a costly shut-down of the casting operation and a clean-up operation. The reduced productivity with the forced shut-down of the casting operation has, in the past, been a significant hinderance in the commercialization of the amorphous metal casting process. Further, the unreliable cutting device is not easily corrected in Smith. Numerous attempts, such as, strengthening the spring action on the gripper, providing better alignment between the two cutting edges, and sharpening the cutting edges have all failed to increase the reliability. The metal ribbon by its nature is very tough and simply tends to spread the two cutting edges, thus trapping the ribbon between the edges without cutting. In other instances, the cutting action may precede the firm gripping action by a fraction of a second allowing the ribbon that is under substantial tension to be pulled loose and cause failure of the winding process. The increased complexity of the multiple part mechanism also increases the initial cost and the general maintenance requirements. Further, the gripping lever closing force provided by the spring fails to compensate for the different rotational forces acting to hold the gripping lever in the open position as the winding wheel rotates at different speeds. Thus, in this prior arrangement it is necessary to precisely time the release so that it occurs at exactly the same speed each time. Otherwise, the gripping lever tends to contact and grip the filament either too early or too late. This puts the contact point spaced away from the optimum position where the filament is laid in contact with the winding wheel by the transfer device. Under these circumstances, the clamping and cutting actions can malfunction leading to the need to abort the casting operation.

A need is therefore, identified for a clamping and cutting apparatus and method providing increased reliability in initiating the winding of a filament upon a rotating winding or storage wheel and cutting the leader.

DISCLOSURE OF THE INVENTION

Accordingly, it is a primary object of the present invention to provide an apparatus and method for improving the reliability of initiating the winding of a cast filament upon a rotating storage wheel and cutting of the leader of the filament.

Another object of the invention is to provide a clamping and cutting apparatus that is less complex with fewer parts and without cooperating cutting edges for improved reliability and maintenance free operation.

An additional object of the present invention is to provide a clamping and cutting apparatus that is self compensating for changes in the rotational speed of the winding wheel so as to provide clamp closing force directly proportional to the speed of winding wheel rotation for proper clamping and cutting action to the filament.

Still another object of the invention is to provide a simplified mechanism for clamping a cast filament to a rotating storage wheel on the fly, and then cutting the filament leader.

A further object of the present invention is to provide a method and apparatus wherein the cutting action occurs by a single, free knife edge following the provision of a firm, positive clamping action to the filament as the storage wheel rotates.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for clamping an advancing cast filament onto a rotating winding wheel, and then cutting the filament leader for disposal. The clamping and cutting apparatus includes a combined clamping and cutting element mounted for rotation with the winding wheel. The element includes a movable clamping arm having a free cutting means, such as a blade edge. The cutting edge is spaced above the hub of the winding wheel and mounted to the side of the clamping arm facing the direction of filament advance. The clamping arm firmly grips the filament first, and only after a firm grip is secured is the blade edge moved into position for cutting action.

Actuating means are provided for moving the clamping arm from an open position away from the hub of the winding wheel to a closed position wherein the arm is in clamping engagement with the filament on the hub. In the closed position, the clamping arm serves to retain the advancing filament on the rotating winding wheel, thereby winding the filament to the wheel and into a reel for storage.

Further, means such as a cooperating set of opposing and counterrotating brush rollers, are provided for pulling the filament leader against the cutting edge of the clamping arm as the winding wheel rotates. This action is what assures that cutting occurs only after the filament is firmly and positively clamped to the winding wheel. From this action, reliable clamping and cutting action for successfully implementing the initiation of the winding process is obtained. In turn, there is a successful reduction in the casting down-time that is common when using prior art devices.

Preferably, the actuating means includes a biasing means, a centrifugal weight, adapted to move the clamping arm from the open to the closed position and a retaining means or member to releasably hold the clamping arm in the open position against the biasing weight. Further, the actuating means includes a triggering means, such as a lever, adapted to release the retaining member so as to permit the biasing weight to move the clamping arm from the open to the closed position so as to clamp and retain the filament to the winding wheel.

In a further aspect of the invention, in accordance with its objects and purposes, a method for clamping an advancing filament or the like to a rotating winding wheel and then cutting the filament leader is disclosed. The first step is tensioning and drawing the filament from the rapidly moving casting surface over the hub and past the winding wheel. Two counterrotating brush rollers forming a nip for receiving the filament can be used for this purpose. After the filament is drawn past the winding wheel in tension, clamping of the filament occurs by means of a combined clamping and cutting element actuated to engage the filament and the wheel. Next is pulling action of the filament against a free cutting edge. The pulling action may be provided, for example, by the same transfer means that is used to draw the filament past the wheel. The pulling results in a cutting action as the wheel rotates and brings the cutting edge of the clamping and cutting element into engagement with the filament leader. Further, advantageously, the cutting action is provided after the filament is firmly and positively clamped to the wheel so as to assure reliable initiation of the winding process.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

BEST MODE OF CARRYING OUT THE INVENTION

Figure 1:
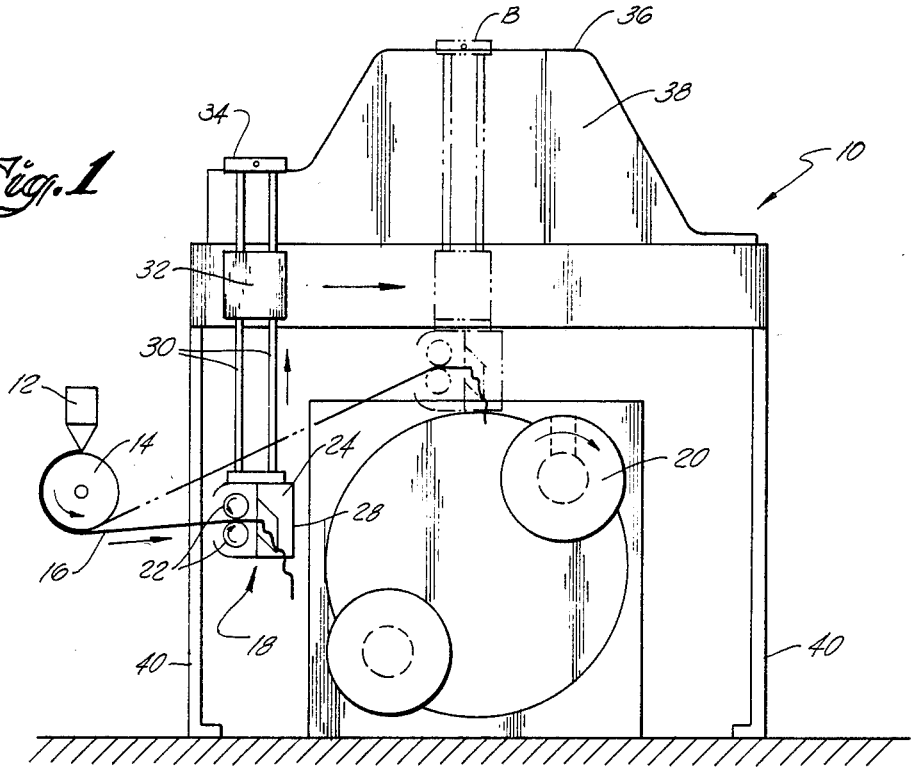
FIG. 1 is an overall side view of an apparatus for the winding of glassy alloy filaments onto a storage wheel in line with the casting machine.

Reference is now made to FIG. 1 showing a continuous amorphous metal casting system 10 for the in line (1) casting of a filament; (2) capturing the filament on the fly; (3) tensioning the filament and transferring to a winding wheel; and (4) winding the filament into a continuous reel. As shown, molten alloy is extruded from nozzle 12 onto the rapidly moving cooling surface or drum 14 so as to form a filament 16. Following casting, the filament 16 is caught and tensioned by a transfer device, generally designated by reference numeral 18. As illustrated in the three positions of FIGS. 1 and 2, the filament is transferred to and wound on a rotating winding wheel 20.

Figure 2:
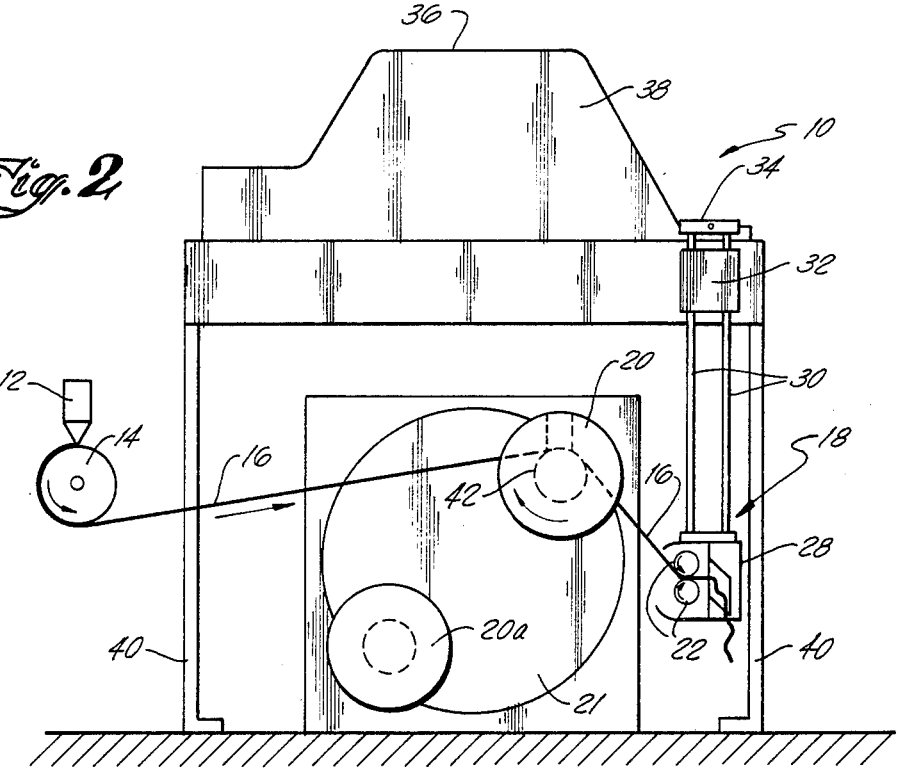
FIG. 2 is a view similar to FIG. 1 showing the filament drawn past the winding wheel while in tension.

A turret 21 is also provided for carrying an additional winding wheel 20*a* (see FIG. 2). The turret 21 is indexed to position the wheel 20*a* for the winding of filament 16 after the completion of a winding operation using the wheel 20.

As shown the transfer device 18 includes two opposing and counterrotating brush rollers 22 forming a nip for receiving the filament 16. The brush rollers 22 are carried by frame 24 and connected to an associated roller drive motor (not shown). The brush rollers 22 are rotated at a speed faster than the independent filament movement so as to continuously overrun and slip, and thereby retain the desired tension upon the advancing filament 16. The tensioning eliminates deleterious slack and flutter in the filament between the rollers 22 and the casting surface 14. As a consequence, the filament may be laid in a controlled fashion on the hub of the winding wheel 20 ready for clamping and winding into a reel.

The above-described components of the transfer device 18 may be collectively termed a take-up head 28. The take-up head 28 is vertically supported by two tubular supporting members 30 that slidably pass vertically through channels within a transfer block 32. The supporting members 30 are secured at their upper extremities to a cam follower block 34 having a roller bearing for tracking along the cam contour 36 of cam plate 38 supported by the U-shaped frame 40.

The transfer block 32 may be driven horizontally across the structure by a conventional pneumatic cylinder (not shown) or any other actuating device known in the art. As the transfer block 32 is driven across the structure, the cam follower block 34 tracks up the cam contour 36 toward position B shown in phantom (FIG. 1). This causes the tubular supporting members 30 to slide vertically and freely through the transfer block 32 so as to move the take-up head 28 toward and over the winding wheel 20 (see FIG. 2). The take-up head 28 is then driven downwardly as the cam follower block 34 tracks down the cam contour 36 after the filament 16 is drawn past the winding wheel 20. This causes the filament 16 to be firmly and positively placed onto the rotating hub 42 of the wheel 20. In this position the brush rollers 22 continue to rotate in an overrunning fashion so as to provide proper tensioning to the filament 16 and to pull the filament leader for proper cutting, as will be discussed in detail below.

Figure 3:
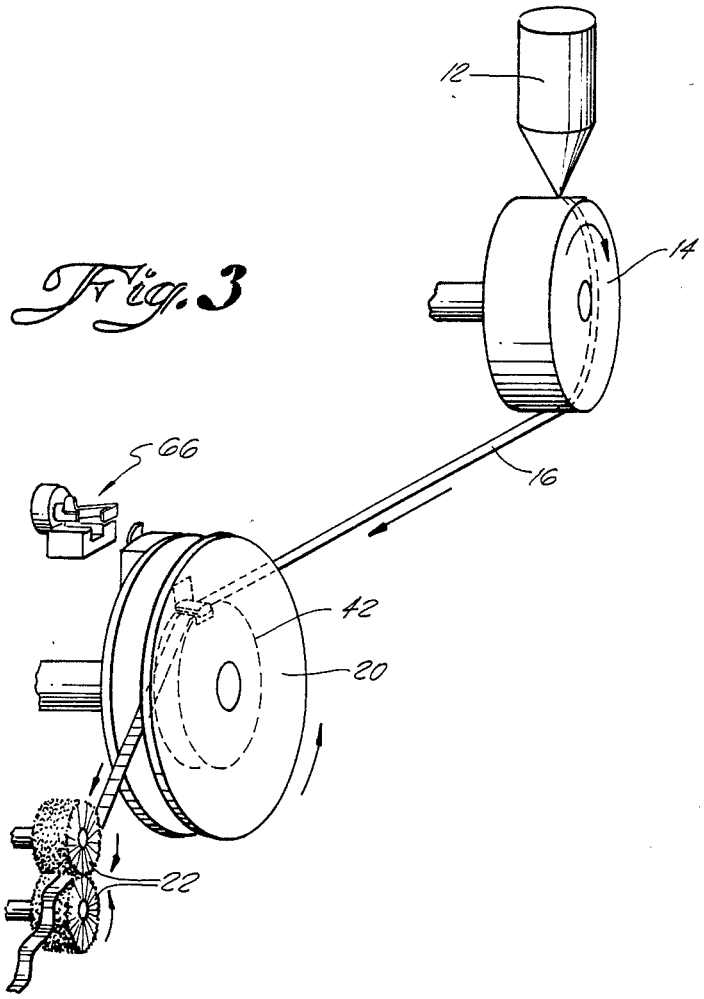
FIG. 3 is a perspective schematic view of the winding device including the clamping and cutting apparatus of the present invention showing the tensioned filament drawn past the winding wheel just after clamping.
Figure 4:
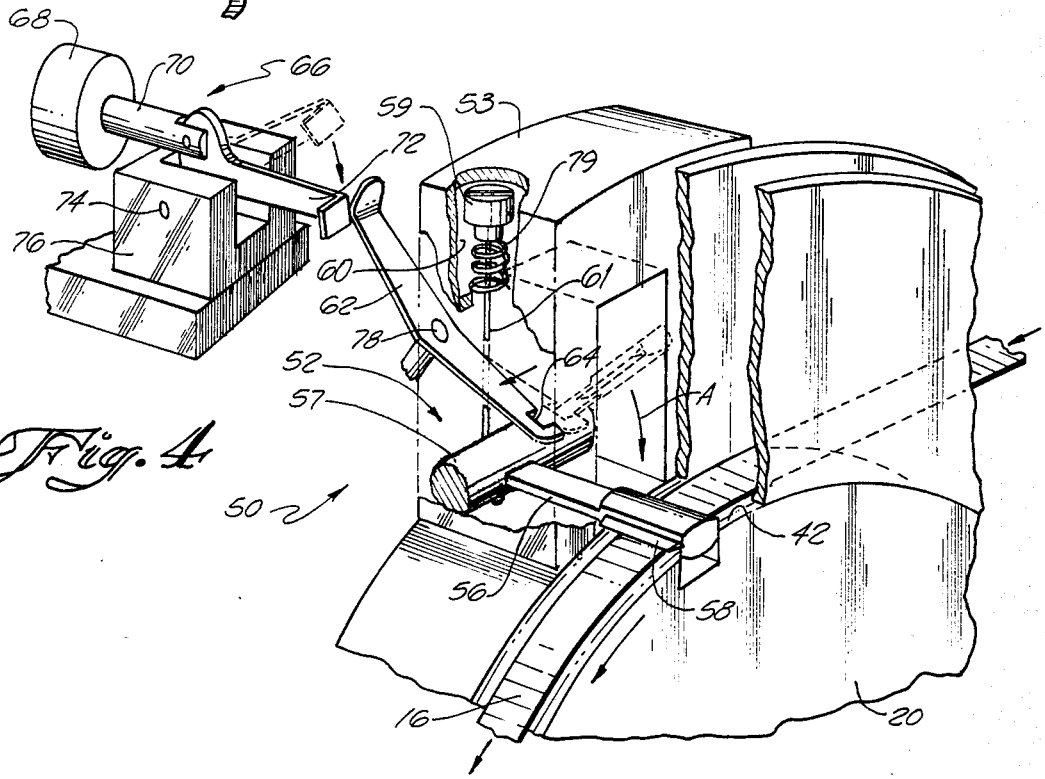
FIG. 4 is a enlarged cutaway view of the clamping-and-cutting apparatus of the present invention showing the clamping arm in the open (phantom outline) and closed positions (full line)

After the filament 16 is drawn past the winding wheel 20 and drawn downwardly so as to provide firm contact with the winding hub 42, by the take-up head 28, the clamping and cutting apparatus 50 of the present invention is actuated (see FIGS. 3 and 4). The clamping and cutting apparatus 50 initially provides clamping action to clamp the filament 16 to the wheel 20, and then cutting action to cut the filament leader from the wheel so as to prevent the leader from disrupting the smooth winding action.

As shown, the clamping and cutting apparatus 50 includes a combined clamping and cutting element 52 mounted in a housing 53 on the wheel 20. The clamping and cutting element 52 includes a movable clamping arm 56 connected to a shaft 57. The clamping arm 56 includes a free cutting blade 58 adjacent to and spaced above the hub or winding surface 42 on the side of the arm facing the direction of filament 16 advance (note FIGS. 4, 5 and 6). Also, the clamping arm 56 is provided with an arcuate bottom surface 59 for firmly engaging and clamping the filament 16 to a corresponding concave recess in the hub 42.

Actuating means are provided for rotating the shaft 57 and moving the clamping arm 56 from an open position away from the hub 42 of the wheel 20 (shown in phantom in FIG. 4) to a closed position (shown in full line) wherein the arm is in clamping engagement. In the closed position, the clamping arm 56 firmly and positively serves to clamp the filament 16 to the wheel 20. As shown, the actuating means includes a biasing means, such as centrifugal weight 59, adapted for generating a self-compensating closing force to the clamping arm 56 allowing successful clamping and cutting operations over a wide range of winding wheel 20 rotational speeds without adjustment. The weight 59 is slidably received in a cylinder 60 that extends in a radial direction to the winding wheel 20 in the housing 53. Thus, as the winding wheel 20 rotates the weight 59 moves outwardly in the cylinder 60 from the winding wheel 20, in response to the centrifugal force. It is this centrifugal force that is used to close the clamping arm 56. This is done by connecting the weight 59 to the shaft 57 by means of a cable 61.

Figure 6:
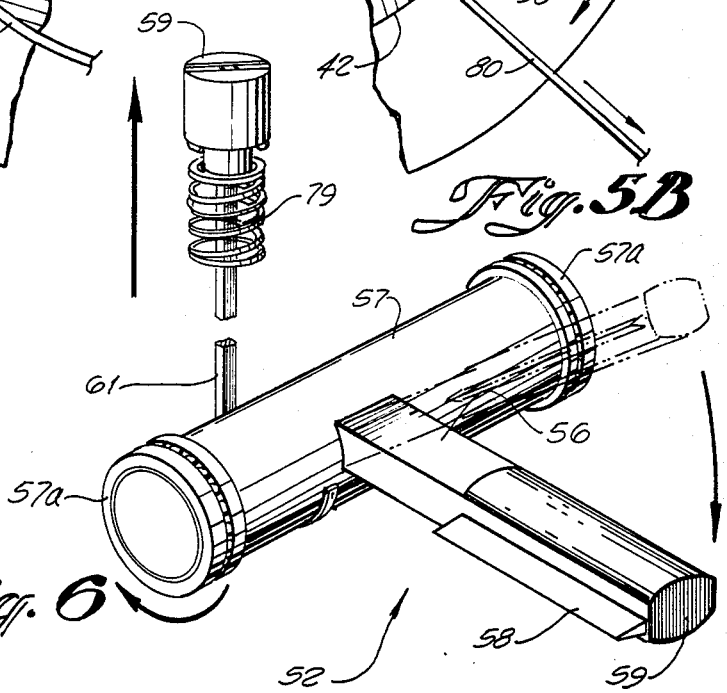
FIG. 6 is a perspective view of the clamping arm and actuation mechanism of the apparatus of the present invention showing the clamping arm in the open (phantom outline) and closed positions (full line).

As shown in FIGS. 4 and 6, one end of the cable 61 is wrapped around the circumference of the shaft 57 carrying the clamping arm 56. The other end of the cable 61 is connected to the weight 59. As the centrifugal weight 59 is drawn outwardly in the cylinder 60 away from the winding wheel 20, it pulls the end of the cable 61 connected to the shaft 57. Thus, the cable 61 serves to translate the centrifugal force generated on the weight 59 during winding wheel rotation into torque to the shaft 57 that is easily rotated in bearings 57*a*. The resulting rotation of the shaft 57 serves to close the clamping arm 56 to clamp the filament 16 to the wheel 20.

The actuating means also includes a retaining member 62. The member 62 includes a notch 64 for receiving the clamping arm 56 and releasably holding the clamping arm in the open position.

Still further, the actuating means includes a triggering mechanism, generally designated by reference numeral 66. The triggering mechanism 66 is adapted to release the retaining member 62 so as to permit the centrifugal weight 59 to move outwardly in cylinder 60 and rotate shaft 57 to cause the clamping arm 56 to move into the closed position (shown full line in the drawings). Specifically, the triggering means includes a solenoid 68, a solenoid rod 70 and a lever 72 pivotally mounted by means of pin 74 to block 76. When the winding of the filament 16 onto the wheel 20 is desired, solenoid 68 is actuated so as to extend solenoid rod 70 and pivot lever 72 from the open position (shown in phantom line) to the triggering position (shown in full line). In the triggering position the lever 72 strikes the retaining member 62 and pivots the member about pin 70 so as to release the clamping arm 56 from the notch 64. The centrifugal weight 59 then moves outwardly in the cylinder 60. This movement draws the cable 61 from the shaft 57, thereby causing rotation of the shaft that pivots the clamping arm 56 in the direction of the arrow A from the open position (shown in phantom line) to the closed position (shown in full line) for engaging the filament 16 and retaining the filament to the winding wheel 20.

As shown in FIGS. 3 and 4, the triggering mechanism 66 is positioned to strike and release the retaining member 62 at a timed location along the upper portion of the path of rotation of the winding wheel 20. This insures that the clamping arm 56 is closed to clamp the filament 16 when wheel 20 is at a point of its rotation wherein the free cutting edge 58 of the cutting arm is spaced above the winding surface or hub 42 and away from the filament (see FIG. 5A). Thus, the clamping and cutting apparatus 50 of the present invention initially only provides a clamping action to retain the filament 16 to the wheel 20.

Advantageously, unlike with prior art spring actuated devices, the force applied by the centrifugal weight 59 to close the clamping arm 56 is directly proportional to the speed of rotation of the winding wheel 20. For example, when the winding wheel 20 is not rotating, the centrifugal closing force is 0. This, of course, allows the clamping arm 56 to be easily and safely reset in the open position where it is engaged by retaining member 62. As should be appreciated, a light spring 79 may be provided to bias the centrifugal weight 59 in the cylinder 60 against the forces of gravity during the reset operation. Further, since the closing force provided is directly proportional to the speed of rotation of the winding wheel 20, the faster the winding wheel 20 rotates, the greater the force applied to the clamping arm 56 by the centrifugal weight 59 and cable 61. Thus, the centrifugal weight 59 compensates for and counteracts the rotational forces tending to hold the clamping arm 56 straight out from the winding wheel 20 in the open position. This is true even as these rotational forces that oppose the closing of the clamping arm 56 increase with increased rotational speed. Further, the increased closing force provided by the centrifugal weight 59 at increased winding wheel rotational speeds serves to close the clamping arm 56 more quickly. Thus, even over a wide range of rotational speeds, the present invention insures the provision of proper clamping action to retain the filament 16 to the wheel 20 prior to the free cutting edge contacting the filament (note FIG. 5A).

Figure 5A:
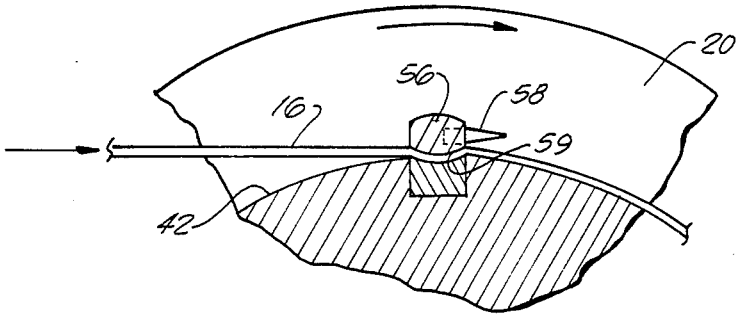
FIG. 5A is a fragmentary cross-sectional view of the winding wheel and hub showing the clamping arm in the initial clamping position.
Figure 5C:
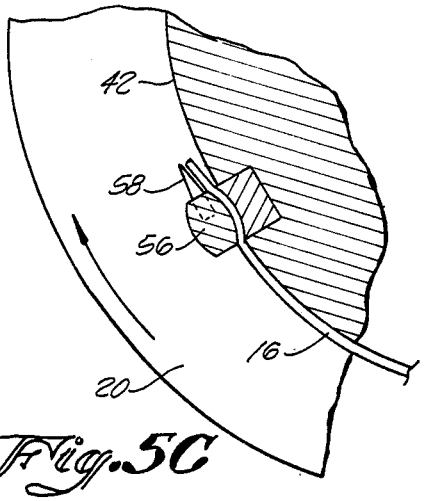
FIG. 5C is a view similar to FIG. 5A and 5B showing the apparatus of the present invention following the application of the clamping and cutting action wherein the filament leader has been clearly removed and discarded and the filament is being smoothly wound onto the wheel.
Figure 5B:
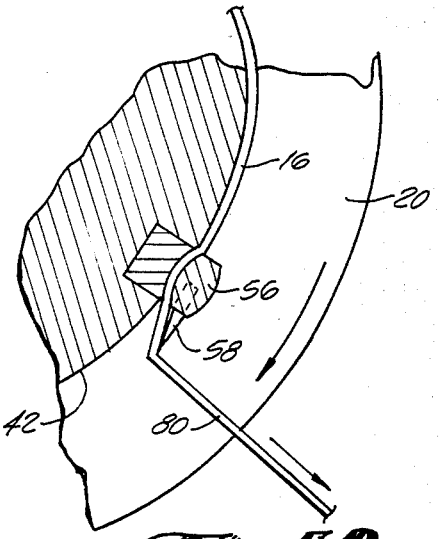
FIG. 5B is a view similar to FIG. 5A showing the filament leader being pulled to engage the free cutting edge of the clamping arm as the wheel rotates from the initial clamping position.

As the wheel 20 continues to rotate after clamping in the direction of the arrows of FIGS. 5A–5C, however, the filament leader 80 is pulled by the rotating brush rollers 22 of the take-up head 28 (not shown) against the cutting edge 58 of clamping arm 56 (see FIGS. 2 and 5 in combination). This serves to sever the filament leader 80 from the winding wheel 20, thereby preventing the leader from disrupting the smooth winding of the filament 16 onto the wheel. The severed filament leader 80 is then drawn through the rotating rollers 22 and cast aside.

In summary, numerous benefits have been described which result from employing the concepts of the present invention. Specifically, a single mechanism is provided for separately performing both the clamping and cutting functions in winding an advancing filament 16 onto a rotating storage wheel 20. Advantageously, the present invention includes a minimum number of parts and consequently, it is more reliable and less expensive then providing separate mechanisms for performing the individual clamping and cutting functions. Further, the apparatus 50 initially firmly and positively clamps the filament 16 to the winding wheel 20 and then subsequently cuts the filament leader 80 free so as to insure smooth, trouble-free winding. Also, it should be recognized that since cooperating cutting edges are not required, misalignment and thus malfunction of the cutter is avoided. The cutting function is assured with the apparatus and method of the present invention since the rotating brush rollers 22 positively pull the filament 16 against the cutting edge 58 of clamping arm 56 as the wheel 20 (see FIGS. 5B, 5C) simply turns for winding.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A clamping and cutting apparatus for utilization on an in-line filament winding device, comprising:

a winding wheel including a hub;

a combined clamping and cutting element mounted for rotation with the winding wheel, said element including a movable clamping arm having a free cutting means adjacent the surface of said hub on a side of the arm facing the direction of filament advance;

actuating means for moving said clamping arm from an open position away from the hub of the winding wheel to a closed position wherein the arm is in clamping engagement with the filament on the hub of the winding wheel so as to retain the advancing filament on the wheel; and means for pulling a leading section of the filament against the cutting means as the winding wheel rotates following clamping engagement so as to cleanly remove said leading section of the filament upstream of said arm for disposal.

2. The clamping and cutting apparatus disclosed in claim 1, wherein said free cutting means of said clamping arm is spaced above the surface of said hub when in the closed position.

3. The clamping and cutting apparatus disclosed in claim 1, wherein said actuating means includes a self-compensating biasing means adapted to move said clamping arm from the open to the closed position.

4. The clamping and cutting apparatus disclosed in claim 3, wherein said self-compensating biasing means includes a centrifugal weight means mounted in a housing connected to the winding wheel; whereby the force of said biasing means proportionally increases with the speed of the winding wheel.

5. The clamping and cutting apparatus disclosed in claim 4, wherein said centrifugal weight means includes a centrifugal weight slidably received in a cylinder extending radially from the winding wheel in said housing.

6. The clamping and cutting apparatus disclosed in claim 5, wherein said clamping arm is mounted to a shaft in said housing and said centrifugal weight means includes cable means connecting said centrifugal weight to said shaft; said cable being wound on said shaft and serving to translate centrifugal force generated by said weight to torque on the shaft for moving said clamping arm from the open to the closed position as the winding wheel rotates.

7. The clamping and cutting apparatus disclosed in claim 3, wherein said actuating means further includes a retaining means adapted to releasably hold said clamping arm in the open position.

8. The clamping and cutting apparatus disclosed in claim 7, wherein said actuating means further includes triggering means adapted to release said retaining means so as to permit said biasing means to move said clamping arm into the closed position for clamping and retaining the filament to the winding wheel.

9. The clamping and cutting apparatus disclosed in claim 1, wherein said clamping arm includes an arcuate bottom surface for tightly engaging the filament on the hub of the wheel.

10. The clamping and cutting apparatus disclosed in claim 1, wherein said pulling means includes at least one set of opposing and counterrotating brush rollers forming a nip for receiving the filament.

11. A method for clamping an advancing filament or the like to a hub of a rotating winding wheel and cutting the leading section of the filament, comprising:

tensioning the filament as it is drawn past the wheel by transfer means;

clamping the filament to the wheel by means of a combined clamping and cutting element actuated to engage the filament and the wheel; and pulling the filament against cutting means of the combined clamping and cutting element as the wheel rotates following clamping engagement so as to cut the leading section of the filament from the wheel.

12. The method claim 11, wherein the leading section of the filament is cut by pulling against a free knife blade positioned above the hub of the winding wheel.

* * * * *